US006815885B1

(12) United States Patent
Bancal et al.

(10) Patent No.: US 6,815,885 B1
(45) Date of Patent: Nov. 9, 2004

(54) FLAT DISPLAY SCREEN RESISTIVE ANODE

(75) Inventors: Bernard Bancal, Luynes (FR); Pascal Olivier, Montpellier (FR)

(73) Assignee: Pixtech S.A., Rousset (FR)

( * ) Notice: Subject to any disclaimer, the term of this patent is extended or adjusted under 35 U.S.C. 154(b) by 0 days.

(21) Appl. No.: 09/511,203

(22) Filed: Feb. 23, 2000

(30) Foreign Application Priority Data

Feb. 26, 1999 (FR) ..... 99 02654

(51) Int. Cl.[7] ..... H01J 63/06
(52) U.S. Cl. ..... 313/496; 313/497; 313/336
(58) Field of Search ..... 313/461, 495, 313/496, 497, 336, 309, 422, 536

(56) References Cited

U.S. PATENT DOCUMENTS 4,720,655 A * 1/1988 Hinotani et al. ..... 313/422
5,764,000 A * 6/1998 Mougin et al. ..... 313/311
6,133,690 A * 10/2000 Meyer et al. ..... 313/495
6,320,309 B1 * 11/2001 Nomura et al. ..... 313/495

FOREIGN PATENT DOCUMENTS

| | | |
|---|---|---|
| DE | 133615 | 1/1979 |
| EP | 0 684 627 A1 | 11/1995 |
| EP | 0 734 042 A1 | 9/1996 |
| JP | 60009039 | 1/1985 |
| JP | 62126528 | 6/1987 |
| JP | 10134740 | 5/1998 |

* cited by examiner

*Primary Examiner*—Alan Cariaso
*Assistant Examiner*—Guiyoung Lee
(74) *Attorney, Agent, or Firm*—Duane Morris LLP

(57) ABSTRACT

A flat display screen anode, including phosphor elements intended for being excited by an electron bombarding, these elements being deposited on at least one biasing electrode including, at least under the phosphor elements, a resistive layer deposited on a conductive layer for biasing the phosphor element.

10 Claims, 2 Drawing Sheets

FLAT DISPLAY SCREEN RESISTIVE ANODE

BACKGROUND OF THE INVENTION

1. Field of the Invention

The present invention relates to a flat display screen anode having phosphors excited by electrons, for example, of microtip type. It more specifically relates to the biasing of phosphor elements of an anode provided with phosphor elements of different colors biased per color, for example, alternate strips of phosphor elements organized in combs.

2. Discussion of the Related Art

FIG. 1 very schematically shows the structure of a flat microtip screen of the type to which the present invention relates. This screen is comprised of two plates. A first plate 1, currently called the cathode plate, is arranged to face a second plate 2, currently called the anode plate. The two plates are spaced apart from each other by spacers 3 regularly distributed in the screen surface, and a vacuum is created in the area defined by the two plates and a peripheral sealing joint 4.

Cathode plate 1 includes electron generation elements and pixel selection elements (not shown) that may be organized in different ways, for example, as described in U.S. Pat. No. 4,940,916 of the Commissariat à l'Energie Atomique in the case of microtip screens. Anode plate 2 is, in the case of a color screen, provided with alternate strips of phosphor elements, each strip corresponding to a color (red, green, blue).

FIGS. 2A and 2B very schematically show a front view and a cross-section view of a portion of an anode plate. In FIG. 2B, the surface corresponding to the internal screen surface faces up. The anode includes, for example, alternate strips 4R, 4G, 4B of respectively red, green, blue phosphor elements. As illustrated in FIG. 2B, the strips of phosphor elements are arranged on corresponding conductive strips 5R, 5G, 5B generally organized in combs, all strips 5R being interconnected, as well as all strips 5G and all strips 5B. In certain cases, the phosphor elements are distributed in elementary patterns, each of which generally corresponds to a pixel (in fact, a sub-pixel of each color for a trichromatic screen). The "pixelized" phosphor elements can then still be addressed by biasing electrodes in conductive strips (5G, 5B and 5R) such as described in relation with FIGS. 2A and 2B, but a specific mask is used to deposit the phosphor elements.

Two great categories of flat screens can be distinguished according to whether the user looks at the screen from the anode side or from the cathode side. In the first case, the light emitted by the phosphor elements propagates through the anode plate (downwards in FIG. 2B). The material of conductive strips 5R, 5G, 5B then is transparent, currently indium and tin oxide (ITO). In the second case, transparent electrodes 5R, 5B, 5G are replaced with opaque and preferably reflective electrodes, so that the largest possible part of the light emitted by phosphor elements 4R, 4G, 4B is sent back to the cathode once the phosphors have been excited by an electron bombardment. Electron generating plate 1 then is at least partially transparent and the observation is performed through this cathode plate.

In a color screen (or in a monochrome screen formed of two alternate sets of strips of phosphor elements of same color), the sets of strips (for example, blue, red, green) are often alternately positively biased with respect to cathode 1, so that the electrons extracted from the emissive elements (for example, the microtips) of a pixel of the cathode are alternately directed towards phosphor elements 4R, 4G, 4B facing each of the colors.

The selection control of the phosphor that is to be bombarded by the electrons imposes controlling, respectively, the biasing of the phosphor elements of the anode, color by color. Generally, the strips 5R, 5G, 5B supporting phosphor elements to be excited are biased under a voltage of several hundreds of volts with respect to the cathode, the other strips being at a zero potential. The choice of the values of the biasing potentials is linked to the characteristics of the phosphor elements and of the emissive means.

In some cases, the anode may, while being formed of several sets of phosphor elements or the like, not be switched by sets of strips. All strips are then biased to a same potential, at least for the duration of a display frame. The anode is then said to be unswitched.

The potential difference between the anode and the cathode is essentially due to the inter-electrode distance, that is, to the thickness of the internal space. A maximum potential difference is desired for reasons of display brightness, which results in searching the greatest possible inter-electrode distance. However, the structure of the inter-electrode space, that includes spacers 3 likely to create dark areas in the screen if their size is too large, prevents from increasing this inter-electrode distance.

The necessary trade off leads to choosing an anode-cathode voltage value that is critical from the point of view of electric arc formation. Destructive electric arcs can then be caused by the smallest dimensional irregularity of the distance separating an emissive means of the cathode from the phosphor elements of the anode. Such irregularities are, moreover, inevitable given the small dimensions and the techniques used to form the anode and the cathode.

On the cathode side, a resistive layer is provided in the case of microtip screens to receive the microtips and thus limit the formation of destructive short-circuits between the microtips and a control grid associated with the cathode.

Conversely, on the anode side, arcs may occur not only between the cathode plate and those of the anode phosphor elements that are biased to attract electrons emitted by the microtips, but also between two neighboring strips of phosphor elements, due to the potential difference between the two strips. In the case of a monochrome screen where the anode is formed of a conductive plane supporting phosphor elements of same color or in the case of an anode (color or monochrome) with several unswitched strips, the risk of arcs only exists between the anode and the cathode.

To limit the occurrence of such lateral arcs, it is currently provided to arrange, between anode strips 5B, 5R, 5G, interstitial strips 7 made of an insulating material (generally silicon oxide).

However, in practice, the efficiency of such insulating strips is limited for several reasons.

First, these strips are inoperative with respect to the forming of electric arcs between the anode and the cathode.

Further, and although this does not necessarily appear in FIGS. 2A and 2B in which the scales have not been respected, phosphor elements 4R, 4G, 4B significantly extend beyond the interstitial strips. Indeed, the thickness of the strips of phosphor elements is generally on the order of some ten $\mu$m and the forming of silicon oxide insulating strips of such a thickness is, in practice, incompatible with the technologies used for manufacturing the anodes, so that the thickness of strips 7 generally is on the order of 1 to 2 $\mu$m, their width being on the order of 10 to 20 $\mu$m.

Further, during the deposition of the phosphor elements through a deposition mask, a slight misalignment of the mask may occur, so that a portion of conductive strips 5R, 5G, 5B or of the insulated areas becomes accessible once the screen is completed and thus favors the forming of arcs.

A first known solution to attempt to reduce the forming of arcs between the anode and the cathode is to provide, at the end of each conductive strip 5R, 5G, 5B, a resistor between the power supply line and the strip. As soon as a strong current appears in the strip, the resistor causes a voltage drop. As a result, the potential difference between the conductive strip and the cathode decreases and has the overvoltage generating the arc disappear.

A disadvantage of such a solution is that it does not protect from the forming of a lateral electric arc, that is, an arc between two neighboring strips 5R, 5G, 5B. A local current circulation may indeed occur between two strips, which is then not prevented by the end resistors.

Another disadvantage of using such resistors in series with the strips is that the resistors are generally made of ruthenium, the resistivity of which is stabilized by anneal. This anneal at high temperature (on the order of 600° C.) necessary to stabilize the resistor raises problems of compatibility with the screen manufacturing process that requires, for the case where the conductive strips are made of aluminum in the case of a transparent anode, temperatures under 600° C. Further, such a manufacturing method by anneal is difficult to control.

Another disadvantage of series resistors interposed between the anode conductive strips is that they form heating areas for the anode conductive tracks at the screen periphery.

A second known solution is described in French patent application Ser. No. 2,732,160. This solution consists of depositing the strips of phosphor elements on strongly resistive strips and bringing the biasing necessary to the phosphors by lateral biasing strips on either side of each resistive strip.

Even though this solution can provide satisfactory results, it requires a significant space between each strip of phosphor elements to house therein two biasing conductors respectively associated with two neighboring strips while sufficiently separating these biasing conductors from each other to maintain a necessary lateral insulation between them. Thus, this solution is, in practice, more particularly intended for screens of low resolution.

Conversely and as an example, for an anode plate in which the surface of each pixel is a square having a side of approximately 300 $\mu$m, the anode strips each have a neighboring width, but under 100 $\mu$m, and insulating strips 7 have a width on the order of some ten $\mu$m. In such a case, the implementation of a solution of local protection by a resistive layer laterally surrounded by biasing strips cannot be envisaged due to the small distance between anode strips.

SUMMARY OF THE INVENTION

The present invention aims at overcoming the disadvantages of conventional techniques by providing a flat display screen anode that suppresses the risk of occurrence of an electric arc between the anode and the cathode plate, or between two neighboring strips of phosphor elements of the anode, without adversely affecting the screen brightness.

The present invention also aims at providing a solution that is compatible with conventional distances between two strips of phosphor elements.

The present invention also aims at providing a solution that is particularly adapted to a "transparent" cathode screen, that is, the cathode plate of which forms the screen display surface.

The present invention further aims at providing a solution that respects conventional anode manufacturing methods and, in particular, the masks used in this manufacturing.

To achieve these objects, the present invention provides a flat display screen anode, including phosphor elements intended for being excited by an electron bombarding, these elements being deposited on at least one biasing electrode including, at least under the phosphor elements, a resistive layer deposited on a conductive layer for biasing the phosphor elements.

According to an embodiment of the present invention, the phosphor elements are directly deposited on the resistive layer.

According to an embodiment of the present invention, the phosphor elements are deposited on a reflective conductive layer, itself deposited on the resistive layer.

According to an embodiment of the present invention, the reflective layer is deposited according to elementary patterns of small dimension in the anode surface.

According to an embodiment of the present invention, the phosphor elements are deposited according to the elementary pattern of deposition of the reflective layer.

According to an embodiment of the present invention, the resistive layer is not patterned.

According to an embodiment of the present invention, the resistive layer has the same pattern as the reflective layer.

According to an embodiment of the present invention, the resistive layer has, at least in the active screen area, the same pattern as the biasing conductive layer.

According to an embodiment of the present invention, said conductive layer has a pattern of alternate strips interconnected in at least two sets.

The present invention a so provides a flat display screen including a cathode generating electrons bombarding a cathodoluminescent anode as mentioned above.

The foregoing objects, features and advantages of the present invention will be discussed in detail in the following non-limiting description of specific embodiments, in conjunction with the accompanying drawings.

DETAILED DESCRIPTION

Figure 1:
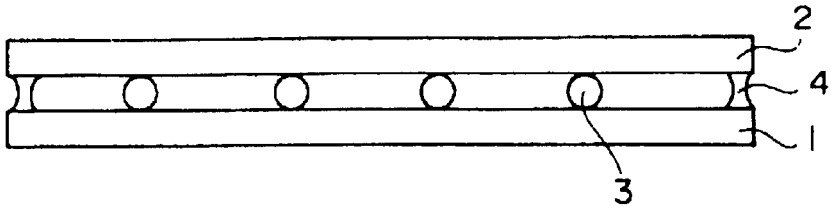
FIGS. 1, 2A and 2B, previously described, are meant to show the state of the art and the problem to solve.

The same elements have been referred to with the same references in the different drawings. For clarity, only those elements necessary to the understanding of the present invention have been shown in the drawings and will be described hereafter. In particular, the structure of the cathode plate of a screen to which the present invention applies has not been detailed and is no an object of the present invention.

Figure 3:
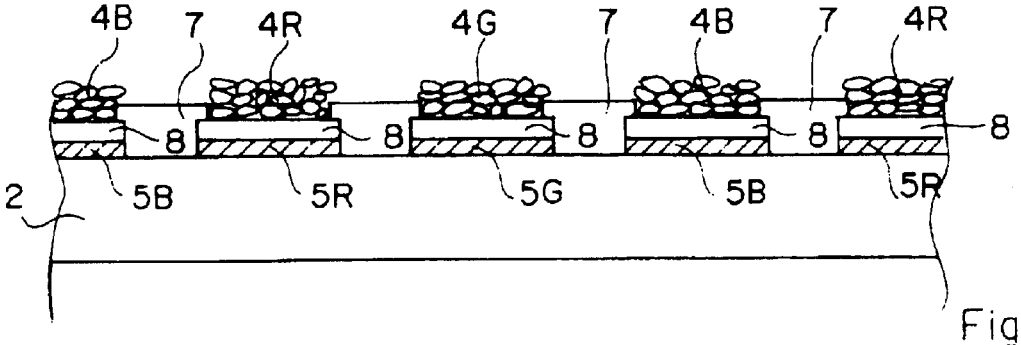
FIG. 3 is a simplified partial cross-section view of a first embodiment of a flat display screen anode plate according to the present invention.

FIG. 3 shows a simplified cross-section view of a flat display screen anode according to a first embodiment of the invention. This anode includes, as previously, a supporting plate 2, for example a glass plate. In the case of a screen observable from the anode, the plate is of course transparent.

Figure 2A:
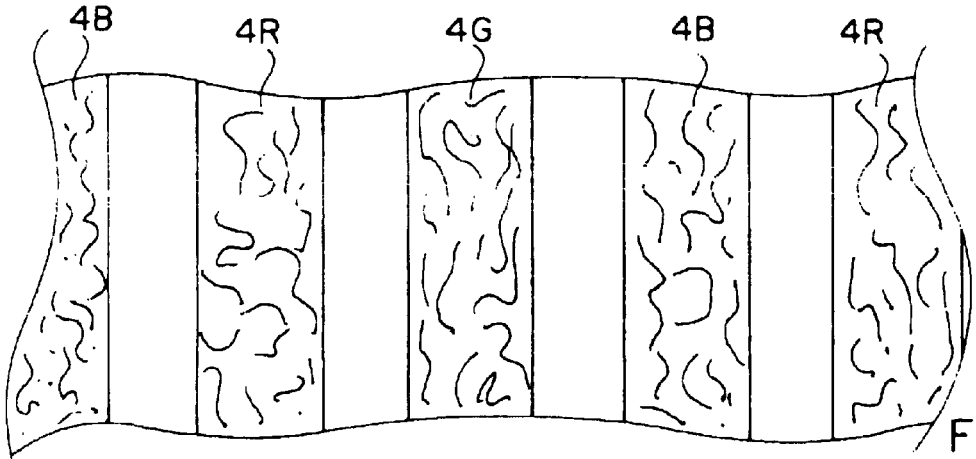
Figure 2B:
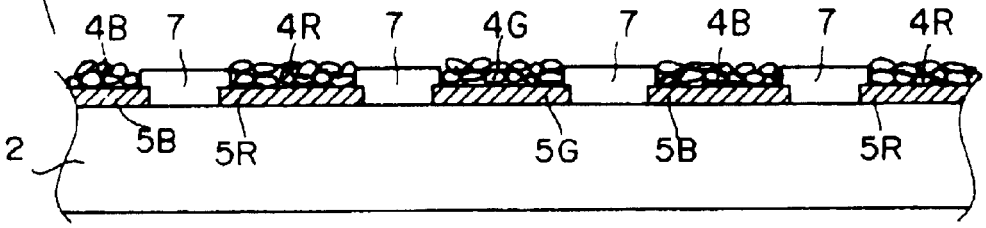

Anode conductive strips 5R, 5G, 5B are deposited, for example conventionally as illustrated in FIGS. 2A and 2B, and are interconnected by sets of strips assigned to a same color.

A feature of the invention is that strips 5R, 5G, 5B, are covered with strips of a resistive material 8. According to the first embodiment of the present invention, strips of phosphor elements 4R, 4G, 4B are then deposited on resistive strips 8 and no longer, as in conventional screens, directly on conductive strips 5. Thus, the biasing electrodes of the phosphor elements comprise a conductive layer (in which are defined strips 5R, 5G, 5B) and a resistive layer 8.

A significant advantage of the present invention is that it conforms with the conventional anode manufacturing method. Indeed, resistive layer 8 can, in the first embodiment, be deposited, at least in the active portion of the screen, that is, outside areas of interconnection of the strip sets, with the same pattern as anode conductive layers 5R, 5G, 5B, and thus by means of a same mask.

Another significant advantage of the present invention is that, while efficiently protecting the screen against destructive electric arcs, the present invention requires no increase of the lateral space between the strips of phosphor elements. The present invention thus is particularly well adapted to anodes of fine resolution.

Conventionally, anode strips 5R, 5G and 5B are preferably laterally separated by insulating interstitial strips 7.

It should be noted that the present invention enables protection against destructive electric arcs not only between the anode plate and the cathode plate, but also between neighboring strips of phosphor elements biased to different potentials. This lateral protection is particularly efficient since it acts against any current flow, even local.

Further, in case of an incidental misalignment of the etch masks used to deposit phosphor elements 4R, 4G, 4B with respect to the mask for forming anode conductive strips 5R, 5G, 5B, the material now accessible is the material of resistive layer 8, which prevents the forming of destructive electric arcs.

The choice of the material constitutive of resistive strips 8 depends on the application and, in particular, on the need for transparency (transparent anode) or for reflectiveness (transparent cathode) of the resistive strips.

As an example of choice of material to form resistive strips 8, tin oxide, or thin silicon, deposited with a thickness preferably ranging between one and two $\mu$m may be used. Conductive anode strips 5R, 5G, 5B are, for example, made of ITO (transparent) or aluminum (reflective) with a thickness on the order of one tenth of a $\mu$m.

It should be noted that the invention provides a significant improvement with respect to series ruthenium resistors that must have a thickness of several tens of $\mu$m.

Further, the first embodiment of the invention also applies to the case of a monochrome screen in which the anode is formed of a plane of phosphor elements of same color or to the case of a screen (color or monochrome) in which the anode is formed of several unswitched sets of strips. In this case, resistive layer 8 is, preferably, deposited over the entire anode conductive layer.

Although the anode according to the invention has been described in relation with a trichromatic structure with elongated anode strips parallel to one another in the first embodiment, the structure of the anode phosphor elements may be very different. For example, it may be a structure of elementary patterns, each of which corresponds to one pixel. In such a case, the present invention provides the additional advantage of being implementable while a lateral protection solution would take too much space.

Figure 4A:
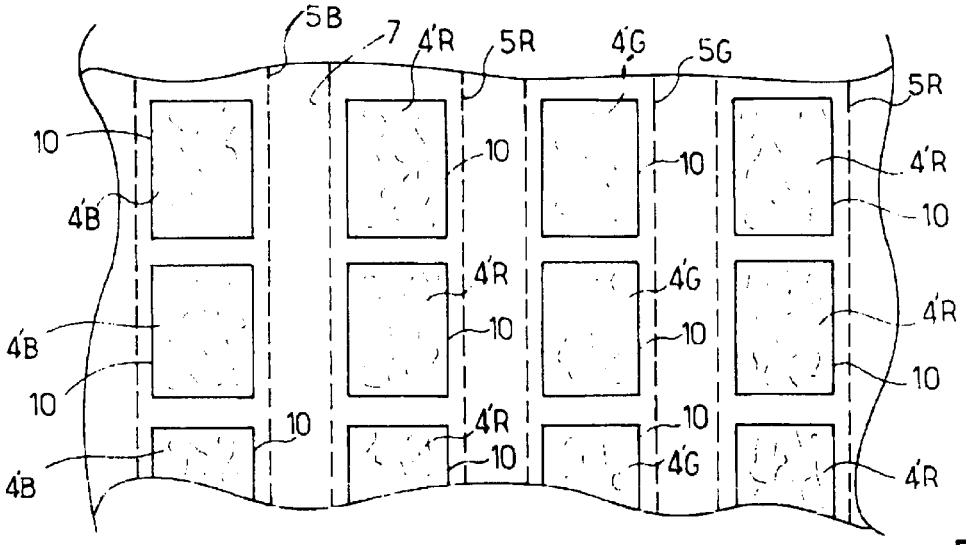
FIGS. 4A and 4B very schematically and partially show, respectively in front view and in cross-section, a second embodiment of a flat screen anode according to the present invention more specifically intended for a screen having its surface formed by the cathode.
Figure 4B:
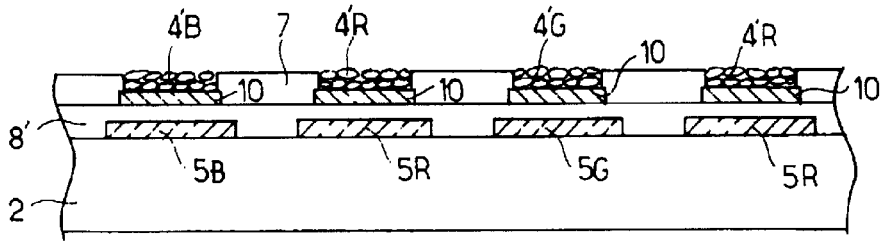

FIGS. 4A and 4B show, respectively in front view and in cross-section, a second embodiment of a flat screen anode according to the present invention. This embodiment is more specifically intended for an anode having to reflect the light towards the cathode plate (1, FIG. 1) that forms the screen surface.

A feature of the second embodiment of the invention is that the biasing electrodes of the phosphor elements are here formed of an arrangement of three layers. As in the first embodiment, a biasing conductive layer 5 and a resistive layer 8 are present. However, according to this second embodiment, an additional conductive layer 10 is deposited on the resistive layer. A feature of this additional layer 10 is to be reflective to reflect light towards the cathode. Thus, conversely to the first embodiment that, when implemented in a transparent cathode screen, provides a reflective resistive layer, the second embodiment enables using a resistive layer having any optical properties (transparent, absorbing or reflective), the reflection towards the cathode being ensured by the additional conductive layer 10.

It should be noted that the second embodiment of the invention more specifically applies to the case where the phosphor elements are deposited in elementary patterns by means of a specific mask including openings, for example, corresponding to the respective sizes of the screen pixels or of the sub-pixels of each screen color. This feature is linked to the presence of conductive layer 10 that must itself be deposited according to the elementary patterns to avoid a charge propagation along the electrode strips.

Thus, as illustrated in FIG. 4A, phosphor elements 4'B, 4'R and 4'G are deposited according to elementary patterns (in this example, rectangular) having small surface areas. It should however be noted that, in the embodiment illustrated by FIGS. 4A and 4B, the distribution of the colors of the phosphor elements is always performed along strips above the conductive biasing strips 5B, 5R, and 5G that are formed according to an alternated strip pattern.

According to this embodiment of the invention, the additional reflective conductive layer is deposited by means of the same mask as the phosphor elements and is thus formed of areas of elementary patterns 10 under the phosphor elements. An insulating layer 7 is optionally provided between the anode strips. Layer 7 is deposited, as in the first embodiment, on resistive layer 8'. However, when provided, insulating layer 7 is then present not only between the anode strips, but also between the different elementary patterns of definition of reflective layer areas 10 and phosphor element areas 4. It should be noted that the tact that the additional conductive layer is deposited according to the elementary patterns enables keeping a floating potential at each pixel.

In the embodiment illustrated in FIGS. 4A and 4B, resistive layer 8' is deposited without being patterned, that is, it extends over at least the entire active area of the anode.

An advantage of the second embodiment of the invention is that it particularly well applies to a transparent cathode screen. Indeed, by dissociating the reflective layer and resistive layer functions, a wider choice of materials is available to form the different layers. In particular, a resistive layer 8' made of an optically absorbing material (for example, silicon) can be provided. In this case, the resistive layer will then form a black matrix wherever there are no phosphor elements and no reflective layer 10. It will then absorb light, which improves the screen contrast.

Further, if the resistive layer is deposited without being patterned, and if it is made of a material with a small secondary emission coefficient (which is generally the case for resistive materials), it will protect the underlying layer between conductive layers 5B, 5R, and 5G that is generally made of a material with a very high secondary emission coefficient, and will then protect the anode against charge effects, which reduces the screen degassing.

As in the first embodiment, an advantage linked to the suppressing of the resistors at the ends of the anode conductive strips is, on the one hand, that space is gained on the anode, but also that the thermal effects due to the presence of these resistors are distributed throughout the entire anode plate, Localized heating, which risks being prejudicial, is thus avoided.

Figure 5A:
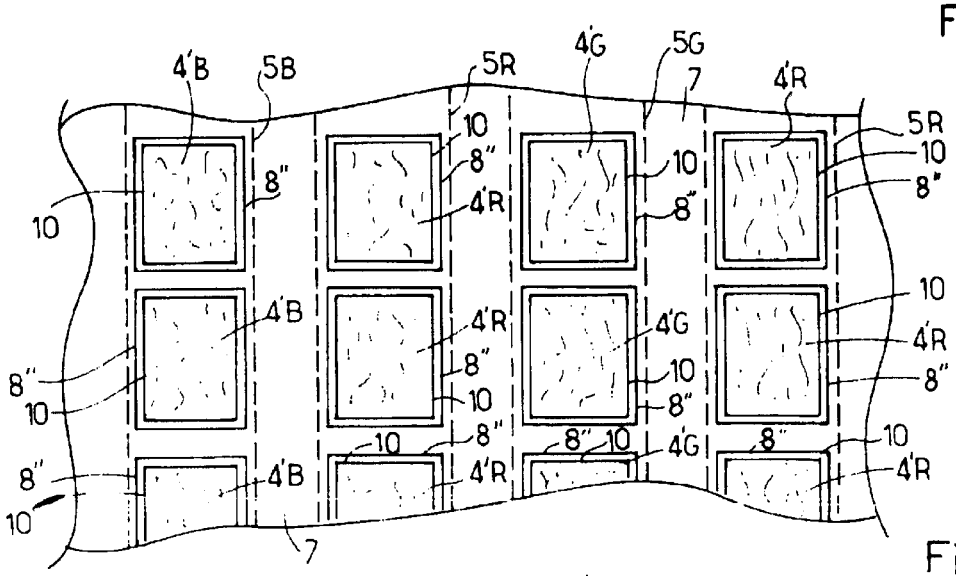
FIGS. 5A and 5B very schematically and partially show, respectively in front view and in cross-section, an alternative of the second embodiment of the present invention.
Figure 5B:
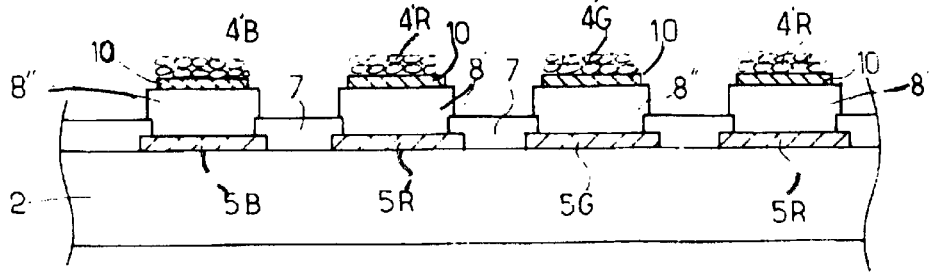

FIGS. 5A and 5B show, respectively in front view and in cross-section, an alternative implementation of an anode according to the second embodiment of the invention. According to this alternative, resistive layer 8" is itself deposited according to the elementary patterns of deposition of phosphor elements 4'. For clarity, the alignment differences between the elementary patterns of phosphor elements 4', of additional conductive layer 10, and of resistive layer 8" have been exaggerated in FIGS. 5A and 5B. It should however be noted that these different elementary patterns are obtained by means of a same mask. Thus, the present invention remains compatible with conventional anode manufacturing methods and, in particular, requires no additional mask, whatever the embodiment used.

In the alternative of FIGS. 5A and 5B, conductive biasing strips 5B, 5R, and 5G have still been shown in strips as in the first embodiment.

It should be noted that, as an alternative, the resistive layer provided in the second embodiment of the present invention may also be deposited according to the pattern of biasing conductive strips 5B, 5R, and 5G. In this case, the advantage of using no additional mask for the deposition of this resistive layer remains, as in the first embodiment.

In FIG. 5B, a resistive layer 8" relatively thicker than that illustrated in FIG. 4B has been shown. Indeed, according to the invention and whatever the embodiment, the value of the resistance can be adjusted according, for a given material, to the thickness of the deposited resistive layer.

Of course, the present invention is likely to have various alterations, modifications, and improvements which will readily occur to those skilled in the art. In particular, It should be noted that, in the case of a monochrome screen or of an unswitched anode screen, and as an application of the second embodiment of the present invention, biasing conductive layer 5 and resistive layer 8 may be deposited without being patterned. Reflective conductive layer 10 and the phosphor elements will then be deposited according to the elementary patterns of the screen pixels. Further, the choice of materials to form a flat screen anode according to the invention is within the abilities of those skilled in the art based on the functional indications given hereabove and on the applications. It should further be noted that those skilled in the art will easily adapt the thicknesses of the different layers and in particular of the resistive layer according to the expected electric characteristics. Moreover, in the case of an unswitched anode, it should be noted that only the strips (or islands) of phosphor elements need individualizing in the active screen surface. Thus, biasing layer 5 may be a conductive plane and the resistive layer may not be patterned. There then is a single anode biasing electrode.

What is claimed is:

1. A flat display screen anode, comprising:

a plurality of phosphor elements (4R, 4G, 4B, 4'R, 4'G, 4'B);

at least one biasing electrode positioned at least under the phosphor elements, the bias electrode comprising;

at least one resistive layer (8, 8', 8"); and at least one conductive layer (5B, 5R, 5G), operable for biasing corresponding ones of the phosphor elements, wherein the at least one resistive layer (8, 8', 8") is deposited on the at least one conductive layer (5B, 5R, 5G).

2. The anode of claim 1, further comprising a reflective layer (10) positioned between corresponding ones of the phosphor elements (4'B, 4'G, 4'R) and the resistive layer (8).

3. The anode of claim 2, wherein the reflective layer (10) is conductive.

4. The anode of claim 3, wherein the reflective layer (10) is organized in elementary patterns.

5. The anode of claim 4, wherein the phosphor elements (4'B, 4'G, 4'R) are organized in an elementary pattern corresponding to that of the reflective layer (10).

6. The anode of claim 2, wherein the resistive layer (8") has the same pattern as the reflective layer (10).

7. The anode of claim 1, wherein the resistive layer (8, 8', 8") is formed without being patterned.

8. The anode of claim 1, wherein the resistive layer (8) has at least within an active screen area, the same pattern as the biasing conductive layer (5).

9. The anode of claim 1, wherein said conductive layer is formed in a pattern of alternate strips (5R, 5G, 5B) interconnected in at least two sets.

10. A flat display screen comprising:

a cathodoluminescent anode (2) comprising:

a plurality of phosphor elements (4R, 4G, 4B, 4'R, 4'G, 4'B) operable to be excited by an electron bombardment;

at least one biasing electrode positioned at least under the phosphor elements, said bias electrode comprising:

at least one resistive layer (8, 8', 8"); and at least one conductive layer (5B, 5R, 5G) for biasing the phosphor elements; and a cathode (1) for generating electrons to bombard the anode, wherein the at least one resistive layer (8, 8'. 8") is deposited on the at least one conductive layer (5B, 5R, 5G).

* * * * *